US010875748B2

(12) United States Patent
Van Veluw et al.

(10) Patent No.: US 10,875,748 B2
(45) Date of Patent: Dec. 29, 2020

(54) MARINE CRANE VESSEL AND METHOD OF OPERATION

(71) Applicant: ITREC B.V., Schiedam (NL)

(72) Inventors: Cornelis Martinus Van Veluw, Schiedam (NL); Joop Roodenburg, Schiedam (NL)

(73) Assignee: ITREC B.V., Schiedam (NL)

( * ) Notice: Subject to any disclaimer, the term of this patent is extended or adjusted under 35 U.S.C. 154(b) by 57 days.

(21) Appl. No.: 16/346,350

(22) PCT Filed: Nov. 10, 2017

(86) PCT No.: PCT/NL2017/050726

§ 371 (c)(1),
(2) Date: Apr. 30, 2019

(87) PCT Pub. No.: WO2018/088900

PCT Pub. Date: May 17, 2018

(65) Prior Publication Data

US 2019/0263638 A1 Aug. 29, 2019

(30) Foreign Application Priority Data

Nov. 11, 2016 (NL) ..... 2017776

(51) Int. Cl.
*B66C 23/52* (2006.01)
*B66C 23/68* (2006.01)
(Continued)

(52) U.S. Cl.
CPC ..... *B66C 23/52* (2013.01); *B66C 23/68* (2013.01); *B66C 23/78* (2013.01); *E02B 17/00* (2013.01);
(Continued)

(58) Field of Classification Search
CPC ..... B66C 23/42; B66C 23/52; B66C 23/68; B66C 23/78; E02B 17/00; E02B 17/08; E02B 2017/0056
See application file for complete search history.

(56) References Cited

U.S. PATENT DOCUMENTS 3,967,458 A * 7/1976 Scales ..... E02B 17/021 405/196
2006/0226105 A1* 10/2006 Roodenburg ..... B66C 13/02 212/196
(Continued)

FOREIGN PATENT DOCUMENTS

CN 2795174 Y 7/2006
CN 201002931 Y 1/2008
(Continued)

OTHER PUBLICATIONS

International Search Report, issued in PCT/NL2017/050726, dated Mar. 9, 2018.
(Continued)

*Primary Examiner* — Michael R Mansen
*Assistant Examiner* — Juan J Campos, Jr.
(74) *Attorney, Agent, or Firm* — Birch, Stewart, Kolasch & Birch, LLP

(57) ABSTRACT

A marine vessel and a method of operation of such a marine vessel include a crane with a boom including a main boom section and a jib section and a variable length stay mechanism. The lattice boom is movable from a hoisting position into a parking position by a routine including operating the variable length stay mechanism allowing the jib section to fold towards the main boom section. The crane is provided with a fixation device adapted to establish fixation of the jib section relative to the main boom section in a folded position. A boom rest is mounted on the hull. The routine further includes operating the luffing assembly to position
(Continued)

the jib member of the folded jib section, fixated to the main boom section, in the parking position onto the boom rest.

11 Claims, 9 Drawing Sheets

(51) Int. Cl.
*B66C 23/78* (2006.01)
*E02B 17/00* (2006.01)
*E02B 17/08* (2006.01)

(52) U.S. Cl.
CPC ..... *E02B 17/08* (2013.01); *E02B 2017/0056* (2013.01)

(56) References Cited

U.S. PATENT DOCUMENTS

2007/0084816 A1* 4/2007 Roodenburg ..... B66C 13/06 212/270
2007/0098504 A1* 5/2007 Roodenburg ..... F16L 1/18 405/166
2010/0243595 A1 9/2010 Walker et al.
2010/0294737 A1* 11/2010 Roodenburg ..... B66C 23/82 212/294
2010/0307401 A1* 12/2010 Bereznitski ..... B66C 23/66 114/122
2011/0031205 A1* 2/2011 Roodenburg ..... B66C 13/06 212/309
2011/0114587 A1* 5/2011 Roodenburg ..... B66C 23/52 212/309
2012/0027525 A1* 2/2012 Vandenbulcke ..... E02B 17/021 405/196
2012/0266797 A1* 10/2012 Ardavanis ..... B66C 23/52 114/85
2014/0231374 A1* 8/2014 Foust ..... B66F 19/00 212/347
2015/0203337 A1* 7/2015 Roodenburg ..... B63B 27/10 212/309
2017/0275142 A1* 9/2017 Yoda ..... B66C 23/26
2019/0106303 A1* 4/2019 Kuninaga ..... B66C 23/342
2019/0248631 A1* 8/2019 Roodenburg ..... B66C 23/52

FOREIGN PATENT DOCUMENTS

CN 101927963 A 12/2010
CN 102674169 A 9/2012
CN 103708362 A 4/2014
CN 103950844 A 7/2014
DE 1 148 720 5/1963
DE 200 02 179 U1 8/2000
JP 2002-255478 A 9/2002
WO WO 2005/030632 A1 4/2005
WO WO 2014/025253 A1 2/2014
WO WO 2015/105414 A1 7/2015

OTHER PUBLICATIONS

Written Opinion of the International Searching Authority, issued in PCT/NL2017/050726, dated Mar. 9, 2018.
Chinese Office Action and Search Report for Chinese Application No. 2017800691105, dated Dec. 26, 2019, with an English translation.
English language abstract for DE-20002179-U1, published Aug. 3, 2000.

* cited by examiner

MARINE CRANE VESSEL AND METHOD OF OPERATION

FIELD OF THE INVENTION

The present invention relates to a marine crane vessel, e.g. a jack-up type vessel and a method of operation of such a marine vessel.

BACKGROUND OF THE INVENTION

It is commonly known to use jack-up type marine vessels for offshore purposes, such as drilling of offshore wells for oil and gas and for the installation of offshore windmills. The term "jack-up type" refers to the use of a jacking system usually involving a rack and pinion mechanism to elevate a hull with respect to the legs.

Such a jack-up type marine vessel comprises a hull and a plurality of generally vertical leg openings through the hull, a plurality of legs, each extending through the hull via one of said vertical leg openings; each of which legs is movable in a vertical direction with respect to the hull, and a plurality of elevating units positioned at the vertical leg openings for changing the elevation of the hull relative to the legs, each of the elevating units being adapted to lift the hull when the legs engage the seabed.

Because of the high loads being transferred from the hull to the legs, the jack-up type marine vessel is structurally quite strong and suitable to support a crane. Advantageously, the jack-up type marine vessel comprises a ring bearing mounted on the hull about one of the vertical leg openings, said ring bearing being structurally anchored to the hull, independently of the leg and its elevating unit. The crane comprises a revolving superstructure mounted upon said ring bearing around the leg, and a lattice boom pivotally mounted to the revolving superstructure.

In this manner, vital space on the deck would be left available for other uses while the space above the vertical leg openings which normally would be free of anything is a location for the crane. Besides the space saving features, the mounting of a crane above the vertical leg opening provides additional strength in that the leg itself acts as a structural support.

Commonly known cranes with a lattice boom comprise a main boom section and a jib section. The main boom section comprises a latticed boom member, the lower end of which is pivotally mounted about a pivot axis to the superstructure, and a main boom strut, an end of which is mounted to an upper end of the boom and extending essentially perpendicular to the boom member, and a boom stay extending between the main boom strut and a lower portion of the boom member.

The jib section is mounted pivotably about a pivot axis to the main boom section and comprises a latticed jib member, an inner end of which is pivotably mounted about pivot axis to the upper end of the latticed boom member, and a jib strut, an end of which is mounted to the inner end of the jib member and extending essentially perpendicular to the jib member, and a jib stay extending between the jib strut and the jib member.

The lattice boom further comprises a variable length stay mechanism provided between the main boom strut and the jib strut.

The crane further comprises a luffing assembly comprising a luffing winch mounted to the superstructure and a luffing cable extending between the superstructure and the main boom section, and a hoist winch, a hoist cable and an object suspension device, the hoist cable extending from the hoist winch along the main boom section and the jib section to the object suspension device.

The luffing assembly is used to position the main boom section. With the variable length stay mechanism, the position of the jib can be set. Once the main boom section and the jib section are set in an appropriate hoisting position, the crane is suitable for hoisting objects by operating the hoist winch and lowering and/or raising the object suspension device.

During transfer of the jack-up type marine vessel, it is advantageous to position the lattice boom in a parking position. It is known to position the lattice boom in a horizontal position, e.g. by operating the luffing winch and paying out the luffing cable. The longer the lattice boom, the more the lattice boom will overhang the hull.

Object of the Invention

It is an object of the present invention to provide a marine vessel with a crane having a boom allowing for an advantageous parking routine and parking position.

SUMMARY OF THE INVENTION

This aim is achieved by a vessel having a crane with a lattice boom which is movable from a hoisting position into a parking position by a routine comprising:

a. keeping the latticed boom member in a raised position;
b. operating the variable length stay mechanism allowing the jib section to fold towards the main boom section;

and wherein the crane is provided with a fixation device adapted to establish fixation of the jib section relative to the main boom section in a folded position; wherein the routine further comprises:

c. fixing the jib section relative to the main boom section by the fixation device to maintain the jib member and the boom member essentially parallel in the folded position;

and wherein a boom rest is mounted on the hull, wherein the routine further comprises:

d. operating the luffing assembly to position the jib member of the folded jib section, fixated to the main boom section in the parking position onto the boom rest.

The effect of this parking routine and parking position is that the overhang of the boom with respect to the hull is reduced. As a result, cranes comprising a longer boom can be provided on a marine vessel. Or, marine vessels with a relatively smaller hull can be applied with a relatively long boom. For example, a hull of 50-70 meters length can support a crane having a length of up to 120 meters above the hull. For example, the main hoist maximum working height above deck may be up to 100-110 meters.

The fixation device of the invention can be provided either at the jib section or the main boom section. Possibly, the fixation device comprises complementary fixation members provided at both the jib section and the main boom section. The fixation device, or the fixation member, is advantageously provided at the latticed boom member or the jib member. The fixation device or fixation member can be embodied as an eyelet for receiving a hook. Possibly, a complementary fixation member is embodied as such a hook.

In embodiments, the fixation device is able to fix the jib section relative to the main boom section by receiving the object suspension device or part thereof. Possibly, the fixation device is embodied as an eyelet or hook, adapted to receive a hook of the object suspension device. Another type of fixation device could be a switchable magnet.

Possibly, the latticed boom member is essentially vertical in step a. This allows the jib section to fold towards the latticed boom member in step b. such that the jib member and the boom member are essentially parallel, after which the fixation device can fix the sections.

In embodiments of the invention, the latticed boom member is at a forwardly angled position in step a. Subsequently, in step b., the jib section will fold towards the main boom section under the influence of gravity, until it hangs downwards in a vertical position. In embodiments, during step b. of the routine the luffing assembly is operated to position the latticed boom member in a vertical position, while allowing the jib section to fold further towards the main boom section. Subsequently, according to step c., the fixation device can fix the sections to maintain the jib member and the boom member essentially parallel in the folded position.

In alternative embodiments, the fixation device comprises a variable length mechanism. As such, after step b., the fixation device is able to further fold the jib section towards the main boom section prior to fixing the sections. For example, the fixation device comprises a winch and cable, or an cylinder provided on the main boom section or the jib section which is able to engage the other section while the jib section hangs down in the vertical position.

Possibly, the vessel is further provided with a control device programmed to perform at least the steps of operating the variable length stay mechanism and operating the luffing assembly of the routine automatically. In such an advantageous embodiment the safety of the operation of moving of the lattice boom into the parking position possible is possibly increased. In particular in the above-described embodiments wherein, during step b. of the routine, i.e. during operation of the variable length mechanism, also the luffing assembly is operated to position the latticed boom member in a vertical position, while allowing the jib section to fold further towards the main boom section, automated control can be advantageous.

In embodiments, the boom rest is mounted on the hull about another one of the vertical leg openings, said boom rest being structurally anchored to the hull, independently of the leg and its elevating unit. This is advantageous as this is a structurally strong position to carry the load of the parked lattice boom. However, It is also conceivable that the boom rest is mounted on an alternative location on the hull, e.g. the deck of the hull.

In an embodiment, the vessel is a jack-up type marine vessel comprising:

- a hull and a plurality of generally vertical leg openings through the hull;
- a plurality of legs, each extending through the hull via one of said vertical leg openings; each of which legs is movable in a vertical direction with respect to the hull;
- a plurality of elevating units positioned at the vertical leg openings for changing the elevation of the hull relative to the legs, each of the elevating units being adapted to lift the hull when the legs engage the seabed;
- a ring bearing mounted on the hull about one of the vertical leg openings, said ring bearing being structurally anchored to the hull, independently of the leg and its elevating unit.

In embodiments with the boom rest mounted about another one of the vertical leg openings, it is conceivable that the leg in this opening is allowed to extend through the latticed jib member and the latticed boom member of the jib section fixated to the main boom section.

Alternatively, it is also conceivable that the latticed boom member and the latticed jib member are allowed to rest on the boom rest offset from the leg in the leg opening.

In embodiments, the height of the boom rest allows an essentially horizontal parking position of the jib section fixated to the main boom section. As the lower end of the boom member is mounted to the superstructure about a pivot axis, the boom member is in a horizontal parking position if the boom rest is positioned at the same level as the pivot axis. Advantageously, the boom rest is positioned more elevated, allowing the jib stay to be essentially horizontal in the parking position, and the main boom strut and jib strut in an essentially vertical position, in line with each other.

The present invention further relates to a method of operation of a marine vessel as described above, in particular for moving the lattice boom of the crane from a hoisting position into a parking position, comprising the steps of:

a. keeping the latticed boom member in a raised position;
b. operating the variable length stay mechanism allowing the jib section to fold towards the main boom section;
c. fixing the jib section relative to the main boom section by the fixation device to maintain the jib member and the boom member essentially parallel in the folded position;
d. operating the luffing assembly to position the jib member of the folded jib section, fixated to the main boom section in the parking position onto the boom rest.

In embodiments, in step a. the latticed boom member is at a forwardly angled position, and wherein during step b. the luffing cable is operated to position the latticed boom member in a vertical position, while allowing the jib section to fold towards the main boom section.

The invention further relates to a method of operation of a marine vessel as described above, in particular for moving the lattice boom of the crane from a parking position into a hoisting position, comprising the steps of:

a. operating the luffing assembly to move the jib section fixated to the main boom section from the parking position onto the boom rest to a vertical position wherein the jib member and the boom member are essentially parallel in the folded position;
b. detaching the jib section from to the main boom section;
c. operating the variable length stay mechanism allowing the jib section to pivot away from the main boom section until the jib section is at a hoisting position;
d. operating the luffing device to position the main boom section in the hoisting position.

The invention further relates to a crane comprising a revolving superstructure, and a boom pivotally mounted to the revolving superstructure, the boom comprising:

- a main boom section, comprising:
  - a boom member, the lower end of which is pivotally mounted about a pivot axis to the superstructure, and
  - a main boom strut, an end of which is mounted to an upper end of the boom and extending essentially perpendicular to the boom member, and
  - a boom stay extending between the main boom strut and a lower portion of the boom member;
- a jib section mounted pivotably about a pivot axis P to the main boom section, comprising:
  - a jib member, an inner end of which is pivotably mounted about pivot axis P to the upper end of the boom member, and a jib strut, an end of which is mounted to the inner end of the jib member and extending essentially perpendicular to the jib member, and a jib stay extending between the jib strut and the jib member;

a variable length stay mechanism provided between the main boom strut and the jib strut;

wherein the crane is further provided with a luffing assembly comprising a luffing winch, preferably mounted to the superstructure, and a luffing cable extending between the superstructure and the main boom section;

wherein the crane is further provided with a hoist winch, a hoist cable and an object suspension device, the hoist cable extending from the hoist winch along the main boom section and the jib section to the object suspension device, wherein the boom is movable from a hoisting position into a parking position by a routine comprising:

a. keeping the boom member in a raised position;

b. operating the variable length stay mechanism allowing the jib section to fold towards the main boom section;

and wherein the crane is provided with a fixation device adapted to establish fixation of the jib section relative to the main boom section in a folded position; wherein the routine further comprises:

c. fixing the jib section relative to the main boom section by the fixation device to maintain the jib member and the boom member essentially parallel in the folded position;

and wherein a boom rest is mounted on the hull, wherein the routine further comprises:

d. operating the luffing assembly to position the jib member of the folded jib section, fixated to the main boom section in the parking position onto the boom rest.

BRIEF DESCRIPTION OF THE DRAWINGS

The invention will be elucidated further in relation to the drawings, in which.

DETAILED DESCRIPTION OF EMBODIMENTS

Figure 1A:
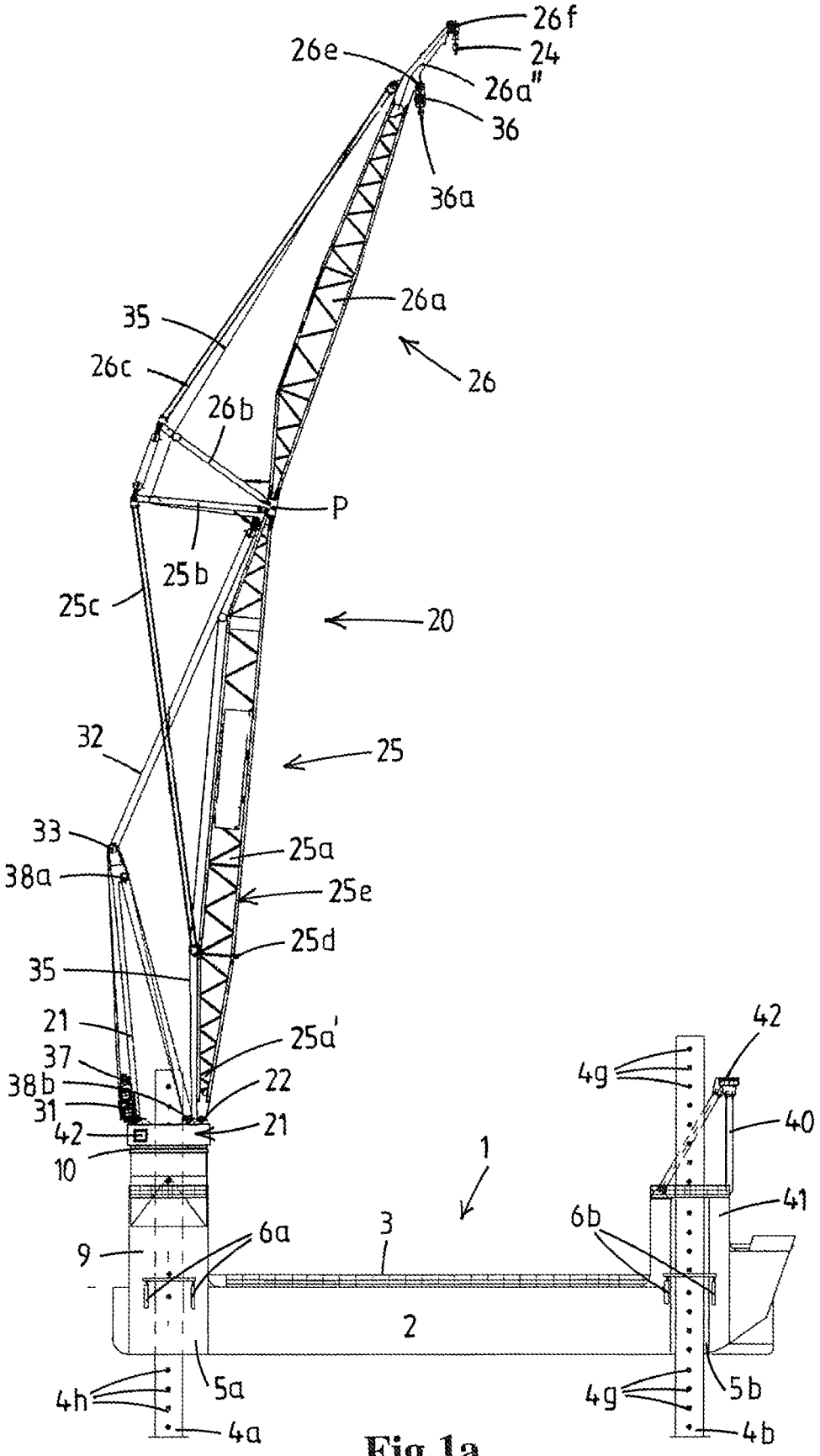
FIG. 1*a* represents a side view of a jack-up type marine vessel according to the invention in a hoisting position.

In FIGS. 1*a*-4, an exemplary jack-up type marine vessel 1 is shown, comprising a hull 2 and a plurality of generally vertical leg openings 5*a*, 5*b* through the hull. Here, the hull is embodied as a vessel. Alternatively, the hull is embodied as a barge or a platform or a semi-submersible or the like. The shown hull 2 comprises a deck 3.

The hull 2 comprises a plurality of generally vertical leg openings 5*a*, 5*b* through the hull. These leg openings are spaced about the hull. Here, two of such openings are visible, while the vessel comprises four of such openings. Generally, a hull comprises 3 or 4 of such openings to provide a stable jack-up type marine vessel.

A plurality of legs 4*a*, 4*b* extend through the hull 2 via the one of said vertical leg openings 5*a*, 5*b*; each of which legs is movable in a vertical direction with respect to the hull. A plurality of elevating units 6*a*, 6*b* is positioned at the vertical leg openings for changing the elevation of the hull relative to the legs, each of the elevating units being adapted to lift the hull when the legs engage the seabed. In the side view, again, only two of such legs are visible, while the vessel comprises four of such legs.

In the legs, openings 4*g*, 4*h* are visible which are able to receive pins (not visible) to fixate the hull relative to the legs.

In embodiments, the elevating units are adapted to lift the hull free of the water surface when the legs engage the seabed. It is also conceivable that the hull is semi-submersible and that the elevating units are able to position the hull partially under water when the legs engage the seabed.

In the shown embodiment, jack-up housings 9, 41 are provided on deck 3 extending a distance above deck and housing the vertical leg openings 5*a*, 5*b* respectively, and the lifting units 6*a*, 6*b* respectively. Legs 4*a*, 4*b* respectively are able to extend through these jack-up housings 9, 41, as visible in the drawings.

In the shown embodiment, a ring bearing 10 is mounted on the jack-up housing 9 which is mounted on the hull 2 about the vertical leg openings 5*a*. Said ring bearing 10 is structurally anchored to the hull 2, independently of the leg 4*a* and its elevating unit 6*a*.

A crane 20 is mounted upon said ring bearing 10. The crane 20 comprises a revolving superstructure 21 mounted upon said ring bearing 10 around the leg 4*a*. The superstructure 21 has an elongated A-shaped frame, also referred to as "gantry". The height of the superstructure is for example about 25 meters, for a lattice boom of about 100-120 meters. The superstructure 21 extends about leg 4*a* and adjacent elevating unit 6*a*. The superstructure 21 is rotatable upon the ring bearing 10 and thus around the leg 4*a*, independently of the leg and its elevating unit. Such a crane-type is known in the art as an 'around the leg-crane'.

The type of crane 20, i.e. a lattice boom crane with a jib is also well known in the art and commonly applied, e.g. in crawler cranes. The jib is sometimes also referred to as a fly-jib, and is generally provided to obtain an increased length of the lattice boom of the crane.

Figure 1B:
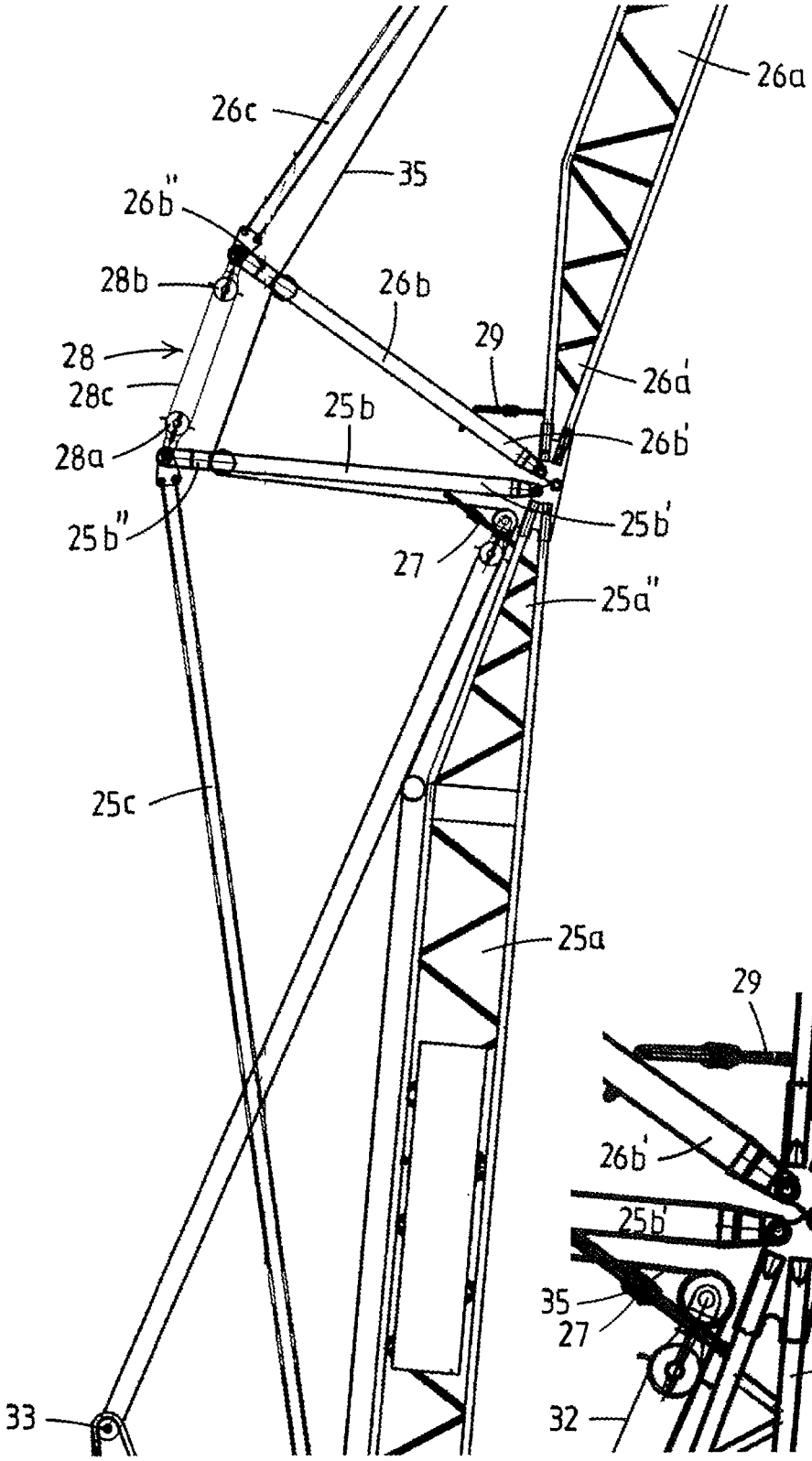
FIG. 1*b* represents a detail of the crane of FIG. 1*a*.
Figure 1C:
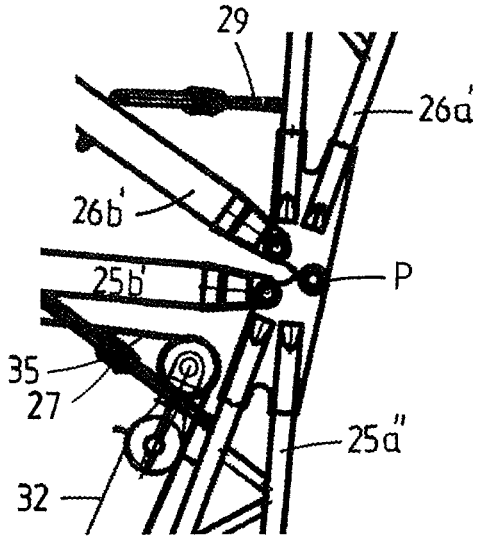
FIG. 1*c* represents a further detail of the crane of FIG. 1*b*.
Figure 1D:
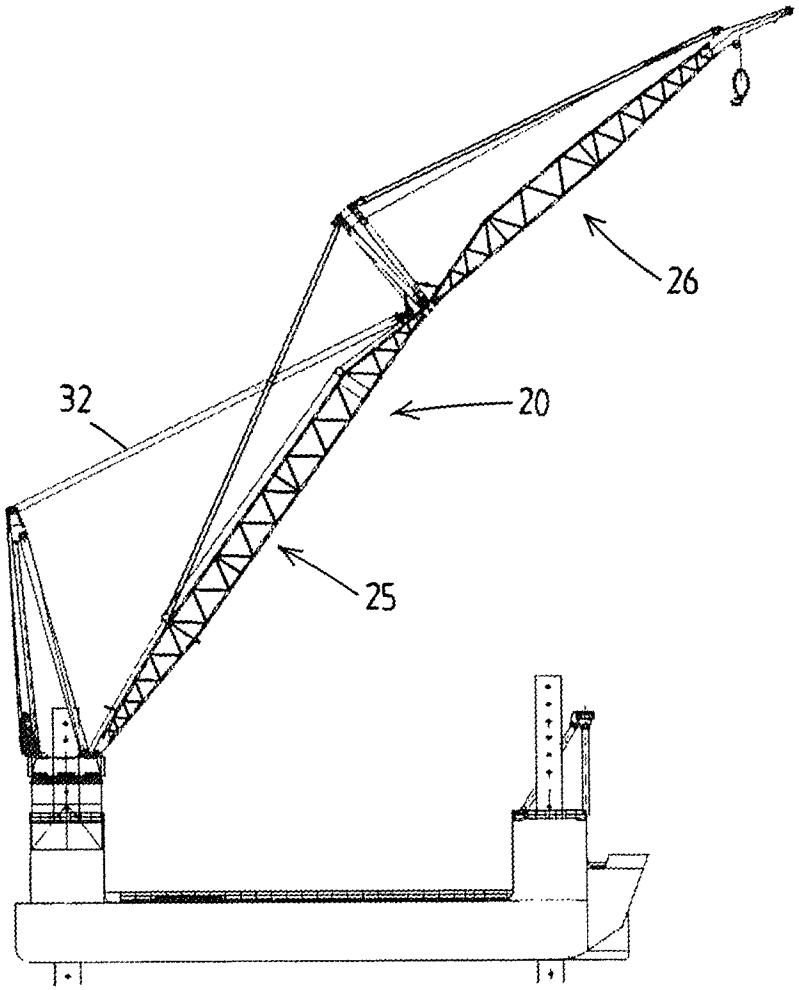
FIG. 1*d* represents a side view of a jack-up type marine vessel of FIG. 1*a* in an alternative hoisting position.

The crane 20 comprises a lattice boom pivotally mounted to the revolving superstructure 21, here in particular to a foot portion of revolving superstructure. The lattice boom comprises a main boom section 25 and a jib section 26 mounted pivotably about a pivot axis P to the main boom section. Details of the crane are shown in FIGS. 1*b* and 1*c*.

The main boom section 25 comprises a latticed boom member 25*a*, the lower end 25*a*' of which is pivotally mounted about a pivot axis 22 to the superstructure 21, here to a foot portion of the superstructure 21. The boom section 25 further comprises a main boom strut 25*b*, one end 25*b*' of which is mounted to an upper end 25*a*" of the boom and extends essentially perpendicular to the boom member. The boom section 25 further comprises a boom stay 25*c* extending between the main boom strut 25*b*, in the shown embodiment from the opposed end 25*b*" of the main boom strut, and a lower portion of the boom member 25.

Here, the boom stay is a fixed boom stay of fixed length. Possibly, a boom stay of variable length is applied. Accordingly, the main boom section comprises a generally triangular shape, in particular a rectangled triangle formed by boom member 25*a*, main boom strut 25*b* and boom stay 25*c*.

In the shown embodiment, a cylinder 27 is provided between the boom member 25*a* and the main boom strut 25*b* to provide structural strength.

The jib section 26 is mounted pivotably about a pivot axis P to the main boom section. The latticed boom member 25*a* comprises a front face 25*e*, opposite the side of the main boom strut 25*b* and the boom stay 25*c*. The pivot axis P advantageously extends forward of this front face 25*e*, allowing the jib section to be fully folded against the main boom section 25.

The jib section 26 comprises a latticed jib member 26*a*, an inner end 26*a*' of which is pivotably mounted about pivot axis P to the upper end 25*a*" of the latticed boom member. The jib section 26 further comprises a jib strut 26*b*, an end 26*a*' of which is mounted to the inner end 26*a*' of the jib member and extends essentially perpendicular to the jib member 26*a*. The jib section 26 further comprises a jib stay 26*c* extending between the jib strut 26*b*, in the shown embodiment from the opposed end 26*b*" of the jib strut 26*b*, and the jib member 26*a*. Here, the jib stay is a fixed jib stay of a fixed length. It is also conceivable that the jib stay has a variable length. Accordingly, the jib section 26 comprises a generally triangular shape, in particular a rectangled triangle formed by jib member 26*a*, jib strut 26*b* and jib stay 26*c*. In the shown embodiment, a cylinder 29 is provided between the jib member 26*a* and the jib strut 26*b* to provide structural strength.

A variable length stay mechanism 28 is provided between the jib section 26 and the main boom section 25, in particular between the main boom strut 25*b* and the jib strut 26*b*. In the shown embodiment, the variable length stay mechanism 28 is provided between an end 25*b*" of the main boom strut 25*b* and end 26*b*" of the jib strut 26*b*.

In the shown embodiment, the variable length stay mechanism 28 comprises two sheaves 28*a*, 28*b*, connected respectively to end 25*b*" of the main boom strut 25*b* and end 26*b*" of the jib strut 26*b*. Between the sheaves a cable 28*c* of adjustable length is provided. Preferably a winch, not shown, is provided to operate the variable length stay mechanism 28.

The crane 20 further comprises a luffing assembly with a luffing winch 31 mounted to the superstructure and a luffing cable 32 extending between the superstructure 21 and the main boom 25. The luffing assembly is provided to position the main boom section of the crane in an appropriate hoisting position. There is a correlation between the maximum load that can be hoisted and the position of the main boom section. Generally, the closer the boom member is to the vertical, the larger the load that it can hoist. In the hoisting position shown in FIG. 1*d*, the maximum load may be e.g. 20,000 kg, while the maximum load in the position shown in FIG. 1*a* may for example be 100,000 kg.

It is advantageous, as shown, for the luffing cable 32 to extend between a top end of the superstructure 21, here via a sheave 33 provided at the top end, as this is advantageous for the interplay of forces to position the main boom section 25.

The crane 20 further comprises a hoist winch 37, a hoist cable 35 and an object suspension device 36. In the shown embodiment, the hoist winch 37 is also mounted to the superstructure 21. The hoist cable 35 extends from the hoist winch 37 along the main boom section 25 and the jib section 26 to the object suspension device 36. In the shown embodiment, the hoist cable 35 extends from hoist winch 37, provided at one end of the A-shaped superstructure 21, over a sheave 38*a* provided at an upper end of the A-shaped superstructure 21 and via sheave 38*b* provided at the opposed lower end of the A-shaped superstructure, via the lower end 25*a* of the boom member to its upper end 25*a*", via the main boom strut 25 to end 25*b*" thereof, along the variable length stay mechanism 28 and then along the jib stay 26*c* to an outer end 26*a*" of the jib member 26*a*.

Here, the outer end 26*a*" comprises a departing sheave 26*e* for the hoist cable 35, to which object suspension device 36 is attached. The outer end 26*a*" further comprises a departing sheave 26*f* for a whip hoist cable (not shown) to which whip hoist 24 is attached. The capacity, also referred to as the "safe working load", of the whip hoist is generally 10-30% of that of the hoist system with hoist winch 37, hoist cable 35 and object suspension device 36. For example, the safe working load of the (main) hoist in an essentially vertical position of the lattice boom is 100,000 kg, with a lattice boom of about 100 meters length, while the capacity of the whip hoist in this position is 20,000 kg. The safe working load of the (main) hoist decreases to 20,000 kg in a position wherein the object suspension device is at a radius of 60 meters away from the revolving superstructure 21.

A boom rest 40 is mounted on the jack-up housing 41 which is mounted on the hull 2 about the vertical leg openings 5*b*. Said boom rest 40 is structurally anchored to the hull 2, independently of the leg 4*b* and its elevating unit 6*b*. Advantageously, a padded structure 42 is provided to receive the lattice boom.

In the shown embodiment, the crane, here in particular the latticed boom member 25*a*, in particular the front face 25*e* thereof, is provided with a fixation device 25*d* adapted to establish fixation of the jib section 26 relative to the main boom section 25 in a folded position. The fixation device 25 is here embodied as an eyelet, adapted to receive a hook 36*a* of the object suspension device 36, as is visible in the parking position of FIG. 3.

Figure 2A:
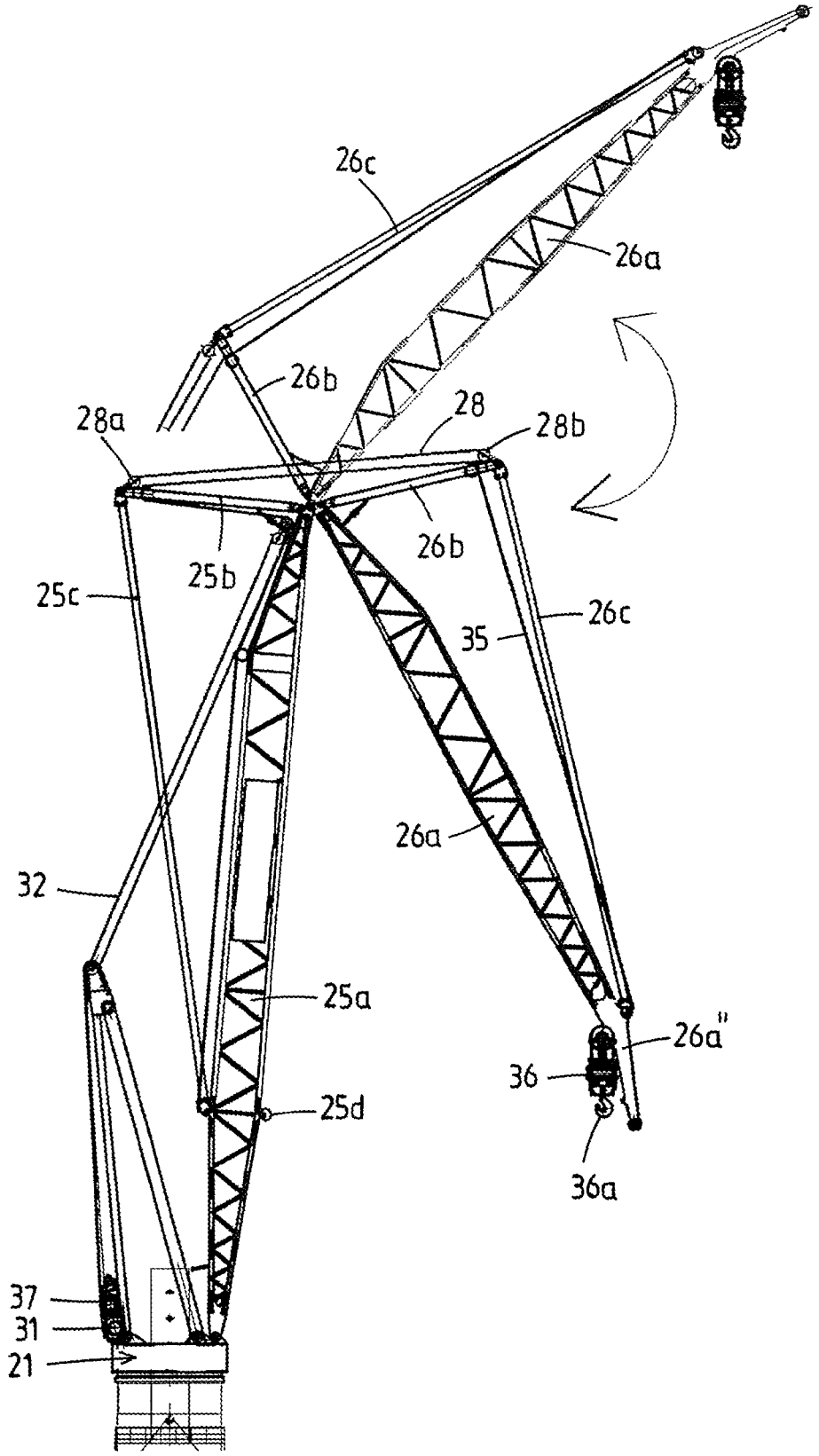
FIG. 2*a* represents a side view of the jack-up type marine vessel of FIG. 1 during the routine of moving the lattice boom from the hoisting position into a parking position, wherein the latticed boom member is in an essentially vertical position.
Figure 3:
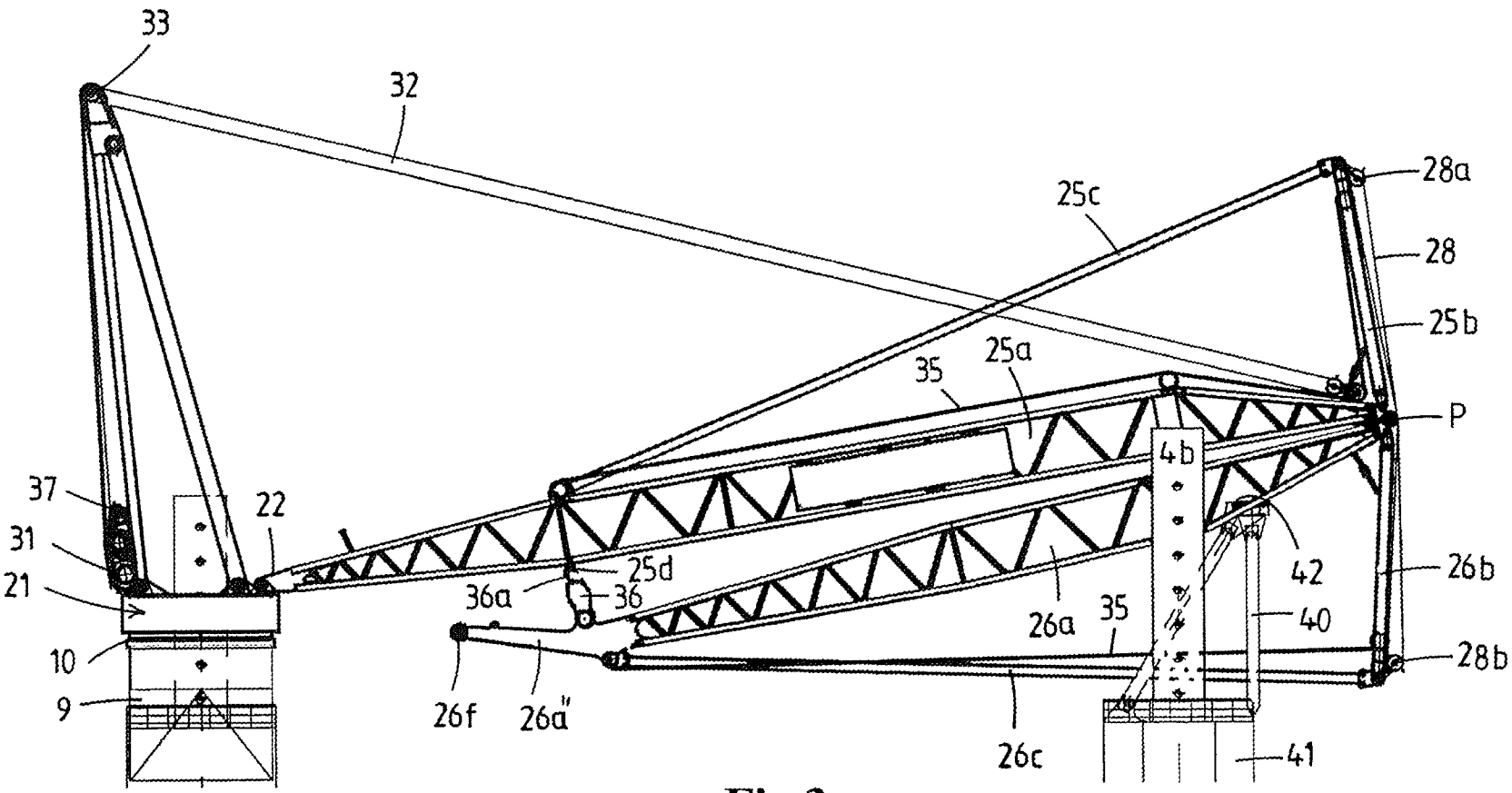
FIG. 3 represents a side view of the jack-up type marine vessel of FIG. 1 with the lattice boom in the parking position.
Figure 4:
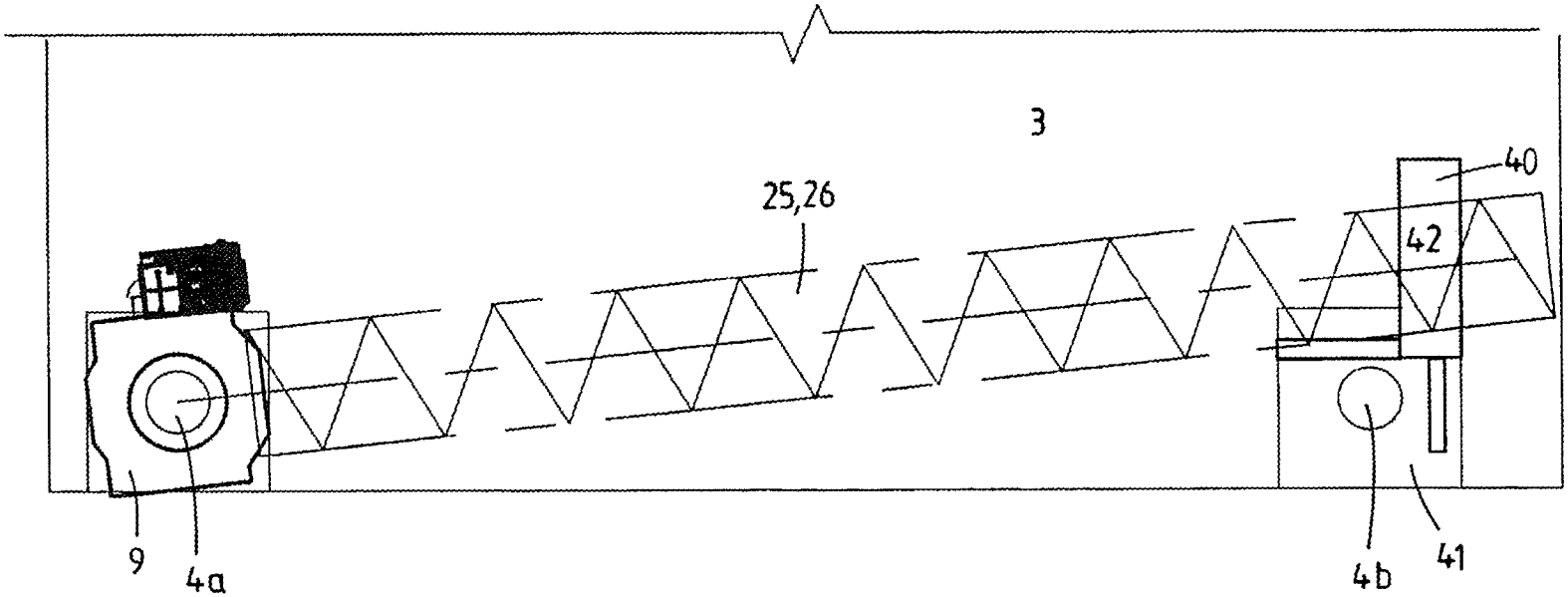
FIG. 4 represents a top view of the jack-up type marine vessel of FIG. 3 with the lattice boom in the parking position.

According to the present invention, the lattice boom is movable from a hoisting position, as visible in FIG. 1, into a parking position as shown in FIGS. 3 and 4, by a routine comprising the following steps:

a. keeping the latticed boom member 25*a* in a raised position, such as the vertical position as shown in FIG. 2*a;*
b. operating the variable length stay mechanism 28 allowing the jib section 26 to fold towards the main boom section 25 about pivot point P, under the influence of gravity;
c. fixing the jib section 26 relative to the main boom section 25 by the fixation device 25*d* to maintain the jib member 26*a* and the boom member 25*a* essentially parallel in the folded position;
d. operating the luffing assembly to position the jib member of the folded jib section, fixated to the main boom section in the parking position onto the boom rest 40.

Figure 2B:
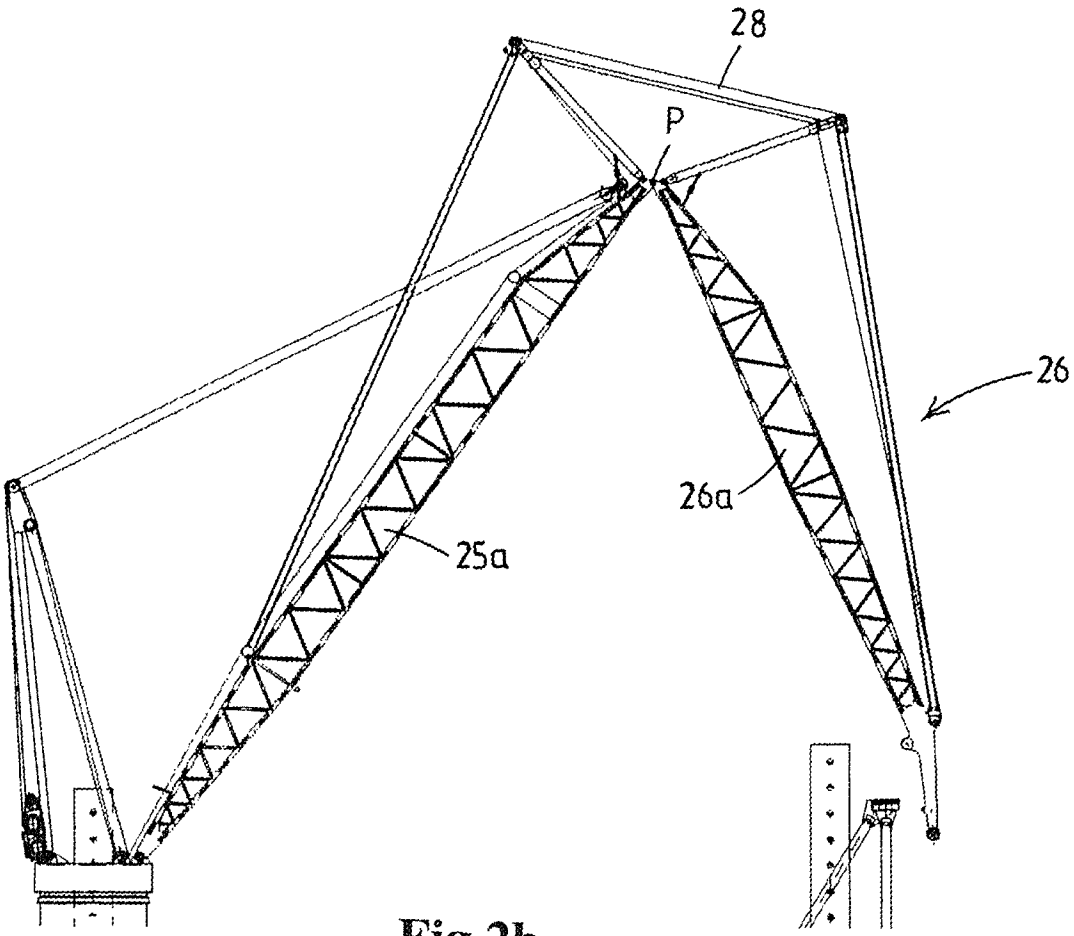
FIG. 2*b* represents a side view of the jack-up type marine vessel of FIG. 1 during a possible routine of moving the lattice boom from the hoisting position into a parking position, wherein the latticed boom member is in a forwardly angled position.
Figure 2C:
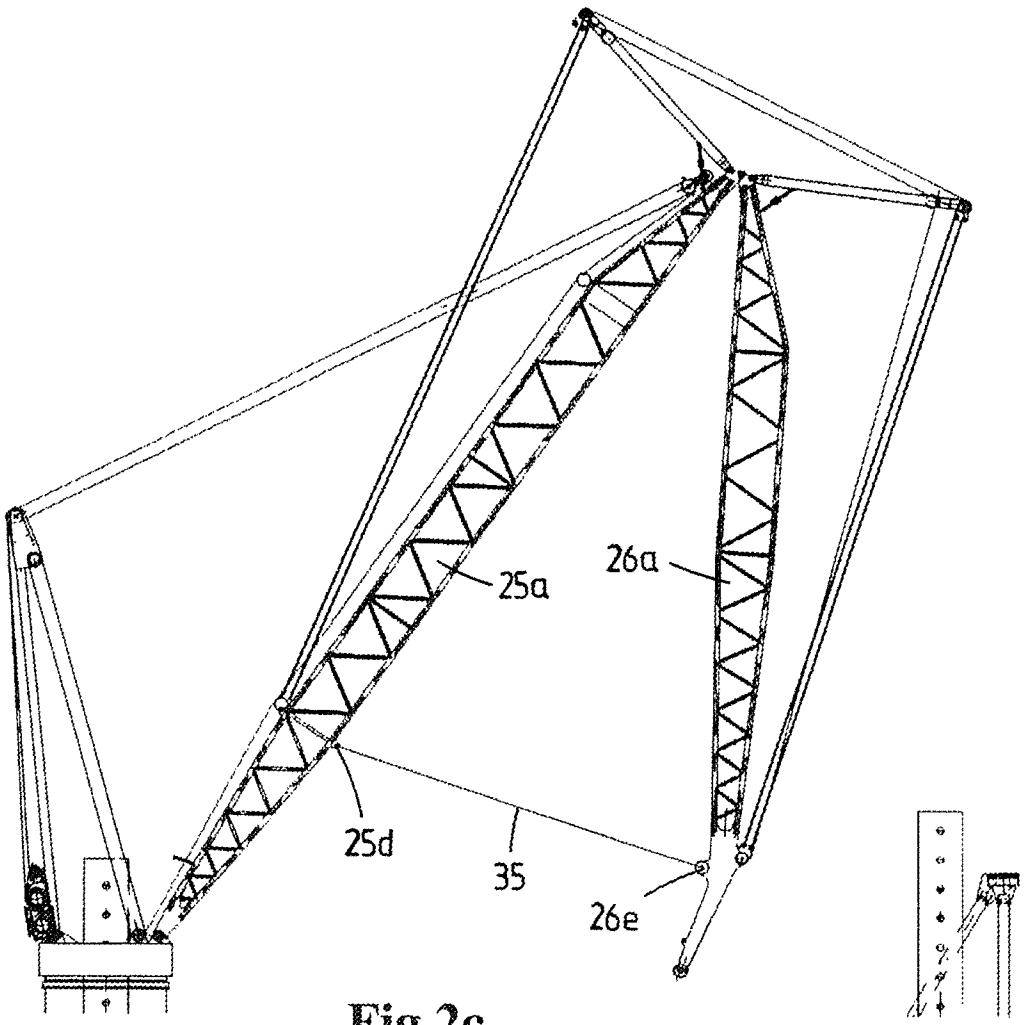
FIG. 2*c* represents a further step of the routine of FIG. 2*b;*

In embodiments, it may be advantageous to have a routine wherein in step a. the latticed boom member is at a forwardly angled position, such as shown in FIG. 2*b*. In this drawing, the variable length stay mechanism 28 has allowed the jib section 26 to fold towards the main boom section 25 about pivot point P. In FIG. 2*c*, it is visible that in the shown embodiment, hook 36*a* of the object suspension device 36 has been attached to the fixation device 25*d* on the latticed boom member 25*a*. The hoist cable 35 spans the distance between the fixation device 25*d* and the sheave 26*e* on the jib member 26*a*. By operating the hoist cable 35 via winch 37, the jib section 25 is allowed to pivot towards main boom section 25, as shown in FIG. 2*d*.

Figure 2D:
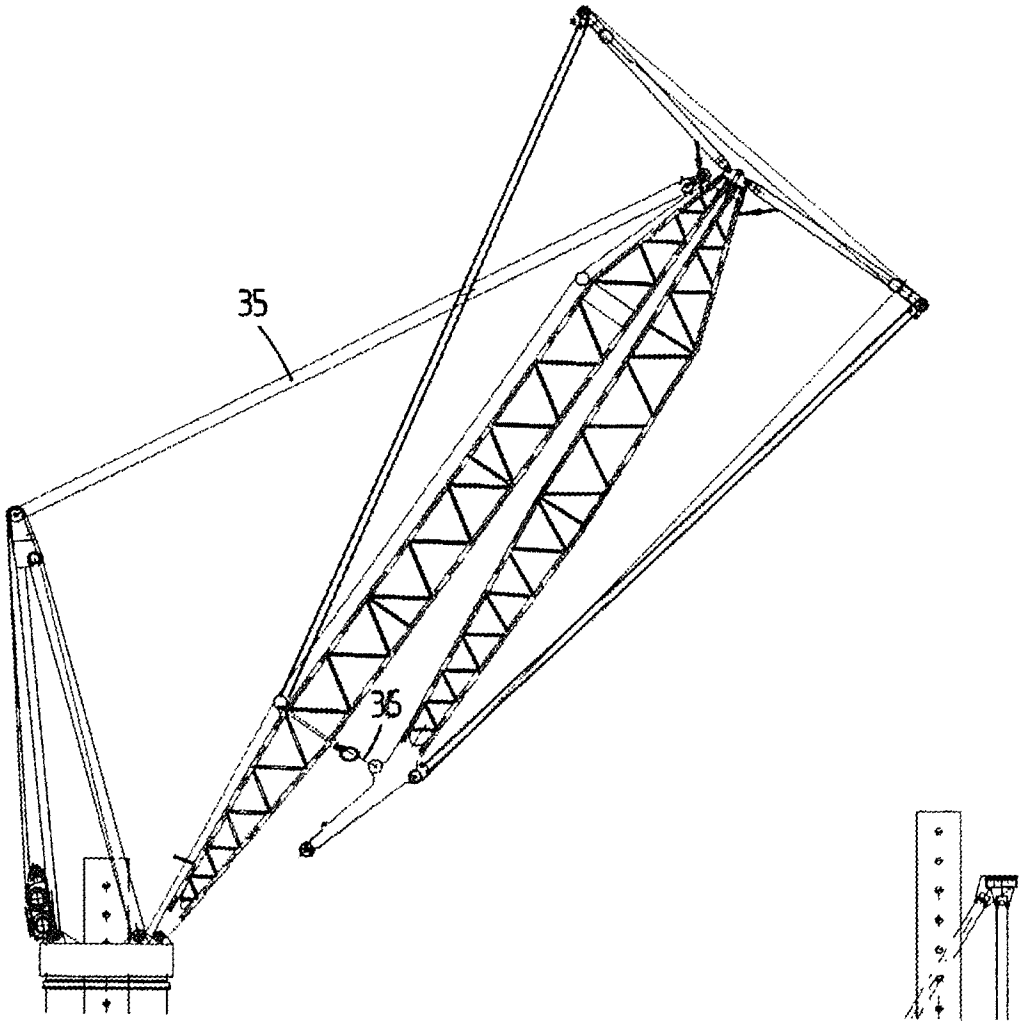
FIG. 2*d* represents yet a further step of the routine of FIG. 2*b;*

From this folded position shown in FIG. 2*d*, the luffing assembly is operated to position the jib member of the folded jib section, fixated to the main boom section, in the parking position onto the boom rest 40 as shown in FIG. 3.

Yet alternatively, not shown, when the latticed boom member is at a forwardly angled position, it is possible to during step b. operate the luffing cable position the latticed boom member in a vertical position, while allowing the jib section to fold towards the main boom section.

It is advantageous if the jack-up type marine vessel further comprises a control device 42 programmed to perform at least the steps of operating the variable length stay mechanism 28 and operating the luffing assembly of the routine automatically.

As visible in FIG. 3, the height of the boom rest 40 is such that the jib stay is essentially horizontal in the parking position, and the main boom strut 25*b* and jib strut 26*b* are in an essentially vertical position, in line with each other. From FIG. 3 follows that in the shown embodiment, the length of the latticed jib member 26*a* essentially equals that of the length of the hull 2, here approximately 60 meters. The length of the latticed jib member 26*a*, here approximately 40 meters, adds up to an overall length of the lattice boom of the crane of 100 meters, while not protruding outside the footprint of the hull of the vessel during sailing.

As visible in FIG. 3, in the folded position of the jib section 26 relative to the main boom section the latticed boom member 25*a* and the latticed jib member 26*a* include an angle of less than 10°, in particular less than 5°.

As visible in FIG. 4, the folded jib section 26 and main boom section 25 rest onto the boom rest offset from the leg 4*b* in the leg opening 5*b*.

The invention claimed is:

1. A marine vessel comprising:
a hull;
a ring bearing mounted on the hull; and
a crane, the crane comprising:
a revolving superstructure mounted upon said ring bearing;
a boom pivotally mounted to the revolving superstructure, the boom comprising:
a main boom section, comprising:
a boom member, the lower end of the boom member being pivotally mounted about a pivot axis to the superstructure; and
a main boom strut, an end of the main boom strut being mounted to an upper end of the boom and extending essentially perpendicular to the boom member; and
a boom stay extending between the main boom strut and a lower portion of the boom member;
a jib section mounted pivotably about a pivot axis to the main boom section, the jib section comprising:
a jib member, an inner end of the jib member being pivotably mounted about the pivot axis to the upper end of the boom member;
a jib strut, an end of the jib strut being mounted to the inner end of the jib member and extending essentially perpendicular to the jib member; and
a jib stay extending between the jib strut and the jib member; and
a variable length stay mechanism provided between the main boom strut and the jib strut;
a luffing assembly comprising a luffing winch mounted to the superstructure and a luffing cable extending between the superstructure and the main boom section; and
a hoist winch, a hoist cable and an object suspension device, the hoist cable extending from the hoist winch along the main boom section and the jib section to the object suspension device,
wherein the boom is movable from a hoisting position into a parking position by a routine comprising:
keeping the boom member in a raised position;
operating the variable length stay mechanism allowing the jib section to fold towards the main boom section, wherein the crane is provided with a fixation device adapted to establish fixation of the jib section relative to the main boom section in a folded position;
fixing the jib section relative to the main boom section by the fixation device to maintain the jib member and the boom member essentially parallel in the folded position, wherein a boom rest is mounted on the hull; and
operating the luffing assembly to position the jib member of the folded jib section, fixated to the main boom section, in the parking position onto the boom rest.

2. The marine vessel according to claim 1, wherein the fixation device is provided at the main boom section.

3. The marine vessel according to claim 2, wherein the fixation device is able to fix the jib section relative to the main boom section by receiving the object suspension device or part thereof.

4. The marine vessel according to claim 1, wherein the fixation device is able to fix the jib section relative to the main boom section by receiving the object suspension device or part thereof.

5. The marine vessel according to claim 1, wherein the fixation device comprises complementary fixation members provided at both the jib section and the main boom section.

6. The marine vessel according to claim 1, wherein in said step of keeping, the boom member is at a forwardly angled position, and wherein during said step operating the variable length stay mechanism, the luffing assembly is operated to position the boom member in a vertical position, while allowing the jib section to fold towards the main boom section.

7. The marine vessel according to claim 1, further comprising a control device programmed to perform at least the steps of operating the variable length stay mechanism and operating the luffing assembly of the routine automatically.

8. The marine vessel according to claim 1, wherein the boom rest is mounted on the hull about vertical leg openings, said boom rest being structurally anchored to the hull, independently of a leg and an elevating unit thereof.

9. Method A method of operation of the marine vessel according to claim 1, for moving the boom of the crane from a hoisting position into a parking position, comprising the steps of:
keeping the boom member in a raised position;
operating the variable length stay mechanism allowing the jib section to fold towards the main boom section;

fixing the jib section relative to the main boom section by the fixation device to maintain the jib member and the boom member essentially parallel in the folded position; and operating the luffing assembly to position the jib member of the folded jib section, fixated to the main boom section in the parking position onto the boom rest.

10. The method according to claim 9, wherein in the step of keeping, the boom member is at a forwardly angled position, and wherein during the step of operating the variable length stay mechanism, the luffing cable is operated to position the boom member in a vertical position, while allowing the jib section to fold towards the main boom section.

11. A method of operation of the marine vessel according to claim 1, for moving the boom of the crane from a parking position into a hoisting position, comprising the steps of:

operating the luffing assembly to move the jib section fixated to the main boom section from the parking position onto the boom rest to a vertical position wherein the jib member and the boom member are essentially parallel in the folded position;

detaching the jib section from to the main boom section;

operating the variable length stay mechanism allowing the jib section to pivot away from the main boom section until the jib section is at a hoisting position; and operating the luffing device to position the main boom section in the hoisting position.

* * * * *